US009193168B2

(12) United States Patent
Ohnishi

(10) Patent No.: US 9,193,168 B2
(45) Date of Patent: Nov. 24, 2015

(54) INK SUPPLY DEVICE

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/443,067

(22) PCT Filed: Nov. 15, 2013

(86) PCT No.: PCT/JP2013/080852

§ 371 (c)(1),
(2) Date: May 14, 2015

(87) PCT Pub. No.: WO2014/077344

PCT Pub. Date: May 22, 2014

(65) Prior Publication Data

US 2015/0290948 A1 Oct. 15, 2015

(30) Foreign Application Priority Data

Nov. 17, 2012 (JP) ..... 2012-252777

(51) Int. Cl.
*B41J 2/175* (2006.01)

(52) U.S. Cl.
CPC ..... *B41J 2/17596* (2013.01); *B41J 2/17509* (2013.01); *B41J 2/17513* (2013.01)

(58) Field of Classification Search
CPC ..... B41J 2/19; B41J 2/1752; B41J 2/17523; B41J 2/17553; B41J 2/17503; B41J 2/17596; B41J 2/17509; B41J 2/17513
See application file for complete search history.

(56) References Cited

U.S. PATENT DOCUMENTS 5,777,646 A * 7/1998 Barinaga et al. ..... 347/86

FOREIGN PATENT DOCUMENTS

| | | |
|---|---|---|
| JP | 2004-49598 | 2/2004 |
| JP | 2005-161636 | 6/2005 |
| JP | 2005-161642 | 6/2005 |
| JP | 2010-23237 | 2/2010 |
| JP | 2011-173417 | 9/2011 |

OTHER PUBLICATIONS

"International Search Report (Form PCT/ISA/210)", mailed on Feb. 10, 2014, with English translation thereof, pp. 1-4.

* cited by examiner

*Primary Examiner* — Juanita D Jackson
(74) *Attorney, Agent, or Firm* — Jianq Chyun IP Office

(57) ABSTRACT

A replaceable ink container of an ink supply device includes an opening plug for plugging an insertion opening into which a male connector is to be inserted. The opening plug includes an outer valve and an inner valve. The outer valve has an outer valve body pressed by the male connector and opened in a case where the male connector is inserted into the insertion opening. The outer valve body is closed by making contact with the male connector in a case where the male connector is pulled out from the insertion opening. The inner valve has an inner valve body indirectly pressed by the male connector and opened in the case where the male connector is inserted into the insertion opening. The inner valve body is closed by receiving at least a pressure of ink in the case where the male connector is pulled out from the insertion opening.

5 Claims, 15 Drawing Sheets

INK SUPPLY DEVICE

CROSS-REFERENCE TO RELATED APPLICATION

This application is a 371 application of the International PCT application serial no. PCT/JP2013/080852, filed on Nov. 15, 2013, which claims the priority benefit of Japan application no. 2012-252777, filed on Nov. 17, 2012. The entirety of each of the above-mentioned patent applications is hereby incorporated by reference herein and made a part of this specification.

TECHNICAL FIELD

The present invention relates to an ink supply device for supplying ink to a recording head for discharging ink in an inkjet printer.

BACKGROUND ART

Conventionally, as an ink supply device for supplying ink to a recording head for discharging ink in an inkjet printer, one provided with a replaceable ink container that is a container for storing ink and being replaceable, and a needle to be inserted into the replaceable ink container to take out the ink from the replaceable ink container is known (Patent Document 1). This replaceable ink container is provided with an opening plug formed of an elastic member such as rubber for plugging an insertion opening to which the needle is to be inserted. With this opening plug being penetrated by the needle, the ink inside the replaceable ink container is taken out to the outside of the replaceable ink container through a passage provided in the needle.

In the meantime, in an inkjet printer with a relatively large consumption amount of ink, that is, in a wide-format inkjet printer with a relatively large printable image size, or in an inkjet printer with relatively fast printing speed, replaceable ink containers are being provided with larger capacities.

Here, in a conventional ink supply device that is provided with a replaceable ink container including an opening plug made of an elastic member and a needle to be inserted into the opening plug, if the needle for taking out the ink inside the replaceable ink container to the outside of the replaceable ink container is thin, a passage provided in the needle becomes narrow accordingly, so that there is a problem that it becomes difficult to supply the ink at a large flow rate from the replaceable ink container. On the other hand, in the conventional ink supply device provided with the replaceable ink container including the opening plug made of the elastic member and the needle to be inserted into the opening plug, if the needle is made larger for supplying the ink at a large flow rate from the replaceable ink container, when the needle is pulled out from the replaceable ink container due to reasons such as changing the ink type and the like in a state where ink still remains in the replaceable ink container, there is a problem that the ink inside the replaceable ink container may possibly leak out to the outside of the replaceable ink container through a hole opened in the opening plug by the needle.

Since there are problems as above, the conventional ink supply device provided with the replaceable ink container including the opening plug made of the elastic member and the needle to be inserted into the opening plug is not suited for making the replaceable ink container have a large capacity.

Conventionally, as an ink supply device provided with a replaceable ink container with a large capacity, one provide with a male connector to be inserted to the replaceable ink container for taking out the ink from the replaceable ink container is known. The replaceable ink container of this ink supply device is provided with an opening plug for plugging an insertion opening into which the male connector is to be inserted. The opening plug is provided with a valve in which a valve body is pushed by the male connector and opened when the male connector is inserted into the insertion opening, and in a case where the male connector is pulled out from the insertion opening, the valve body closes by making contact with the male connector.

PRIOR ART DOCUMENT

Patent Document

Patent Document 1: JP 2010-23237 A

SUMMARY OF THE INVENTION

Problem to be Solved by the Invention

However, in the conventional ink supply device including the replaceable ink container provided with the opening plug having the valve and the male connector to be inserted into the opening plug, when the male connector is pulled out from the replaceable ink container due to reasons such as changing the ink type and the like in the state where ink still remains in the replaceable ink container, there is a problem that the valve, which is supposed to be sealed, is not sealed due to a defect, and a large amount of ink may possibly flow out via the valve from the replaceable ink container. In the case where such a large amount of ink is to flow out from within the replaceable ink container, the inkjet printer might contaminate various things, for example user's clothing, floor on which the inkjet printer itself is installed, and the inkjet printer itself, by the ink that has flown out.

Thus, the present invention aims to provide an ink supply device that can reduce the possibility of the ink flowing out from the replaceable ink container when the male connector is pulled out from the replaceable ink container compared to in the conventional configuration.

Solutions to the Problem

An ink supply device of the present invention is an ink supply device for supplying ink to a recording head for discharging the ink in an inkjet printer, the ink supply device including: a replaceable ink container being a container for storing the ink and being replaceable; and a male connector to be inserted into the replaceable ink container to take out the ink from the replaceable ink container, wherein the replaceable ink container has an insertion opening where the male connector is to be inserted formed therein, the replaceable ink container includes an opening plug that plugs the insertion opening, the opening plug includes an outer valve and an inner valve, in an order from an outer side toward an inner side of the replaceable ink container, the outer valve includes an outer valve body that is a valve body for opening and closing, the outer valve is a valve that has the outer valve body pressed by the male connector and opened in a case where the male connector is inserted into the insertion opening, and has the outer valve body close by making contact with the male connector in a case where the male connector is pulled out from the insertion opening, the inner valve includes an inner valve body that is a valve body for opening and closing, and the inner valve is a valve that has the inner valve body pressed directly or indirectly by the male connector and opened in the case where the male connector is inserted into the insertion opening, and has the inner valve body close by receiving at least a pressure of the ink in the case where the male connector is pulled out from the insertion opening.

According to this configuration, in the case where the male connector is pulled out from the replaceable ink container, in the ink supply device of the present invention, even if the outer valve, which is supposed to be sealed, is not sealed due to a defect, the possibility of ink leak from the replaceable ink container can be reduced compared to in the conventional configuration, since the inner valve having received the ink pressure closes automatically.

Furthermore, in the ink supply device of the present invention, the inner valve may be a valve to which closing force is applied by self-weight of the inner valve body in the case where the male connector is pulled out from the insertion opening.

According to this configuration, the ink supply device of the present invention can improve certainty that the inner valve will close, since the closing force is applied to the inner valve not only by the ink pressure but also by the self-weight of the inner valve body in the case where the male connector is pulled out from the replaceable ink container.

Furthermore, in the ink supply device of the present invention, the inner valve may further include a biasing unit that biases the inner valve body in a direction along which the inner valve body closes.

According to this configuration, the ink supply device of the present invention can improve certainty that the inner valve will close, since the closing force is applied to the inner valve not only by the ink pressure but also by the biasing force by the biasing unit in the case where the male connector is pulled out from the replaceable ink container.

Furthermore, in the ink supply device of the present invention, at least one of the outer valve and the inner valve may be a reed valve, and the reed valve may be a valve to which closing force is applied by rigidity of the valve body itself in the case where the male connector is pulled out from the insertion opening.

According to this configuration, the ink supply device of the present invention can improve certainty that the valve being the reed valve among the outer valve and the inner valve will close, since the reed valve is automatically closed by the closing force being applied by the rigidity of the valve body itself in the case where the male connector is pulled out from the replaceable ink container. It should be noted that, in the case where the inner valve is the reed valve, in the ink supply device of the present invention, the closing force is applied to the inner valve being the reed valve, not only by the rigidity of the valve body itself but also by the ink pressure, and it automatically closes.

Effects of the Invention

The ink supply device of the present invention can reduce the possibility of ink leaking from the replaceable ink container in the case where the male connector is pulled out from the replaceable ink container compared to in the conventional configuration.

EMBODIMENTS OF THE INVENTION

Hereinbelow, embodiments of the present invention will be described with reference to the drawings.

First Embodiment

Firstly, a configuration of an inkjet printer according to the present embodiment will be described.

Figure 1:
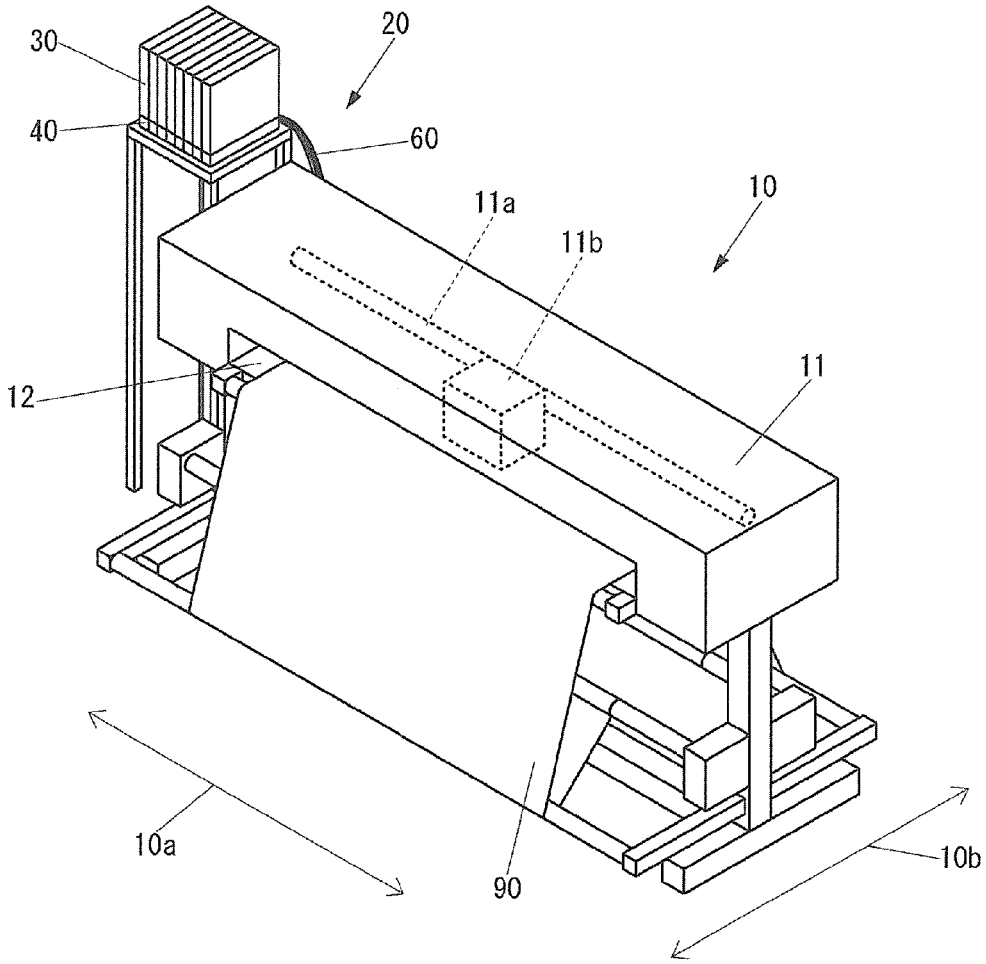
FIG. 1 is a perspective view of an inkjet printer according to a first embodiment of the present invention.

FIG. 1 is a perspective view of an inkjet printer 10 according to the present embodiment.

As shown in FIG. 1, the inkjet printer 10 includes a main body 11 extending in a main scanning direction shown by an arrow 10*a*, a transfer device 12 that transfers a recording medium 90 such as a paper, and an ink supply device 20 for supplying ink to a recording head 11*c* described later that discharges the ink.

The main body 11 includes a guide rail 11*a* extending in the main scanning direction shown by the arrow 10*a*, and a carriage 11*b* supported on the guide rail 11*a* so as to be movable in the main scanning direction shown by the arrow 10*a*. The carriage 11*b* is mounted with recording heads 11*c*.

The transfer device 12 is a device that transfers the recording medium 90 in a sub scanning direction shown by an arrow 10*b* relative to the recording heads 11*c* of the main body 11.

Figure 2:
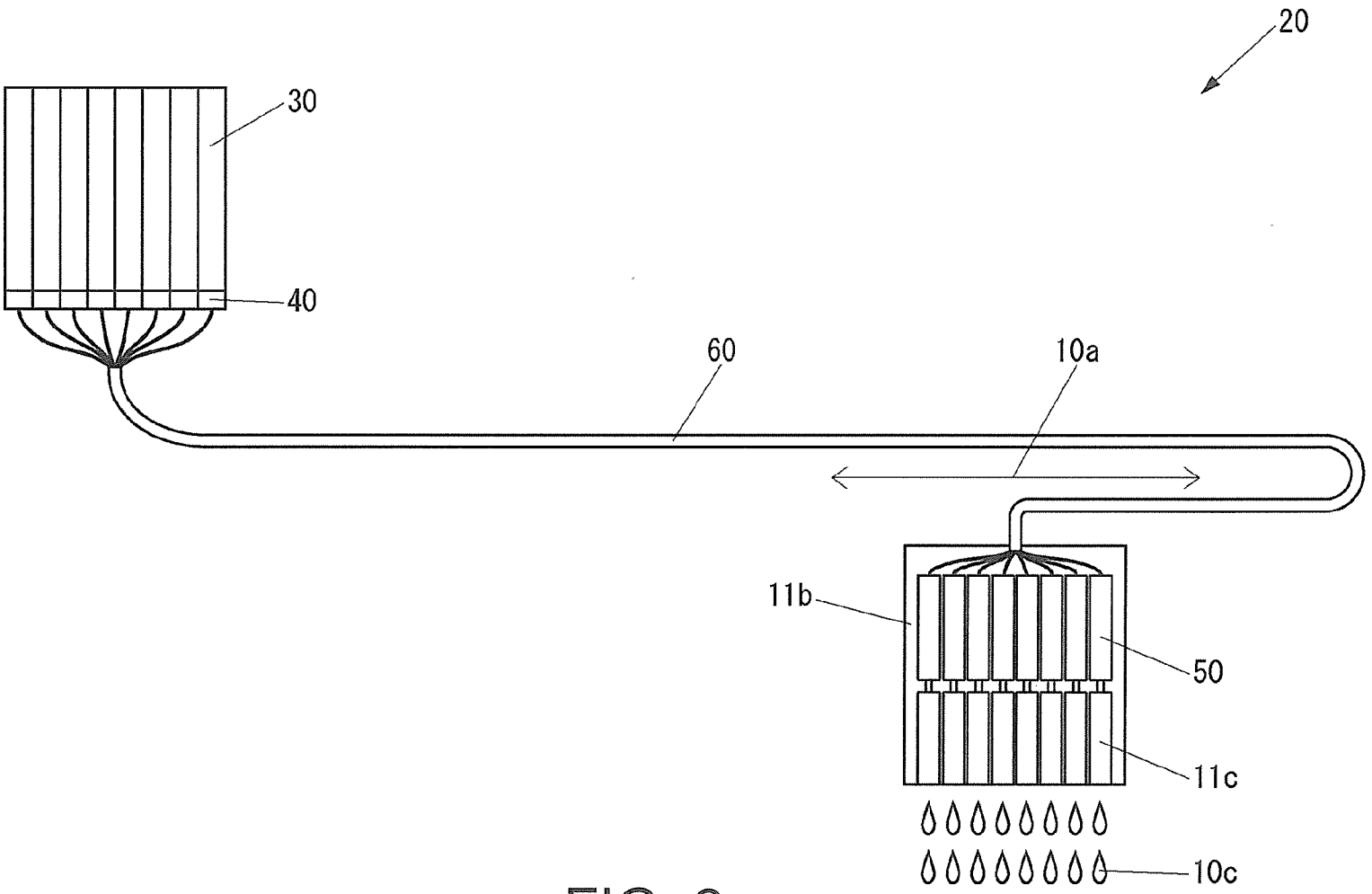
FIG. 2 is a schematic diagram of the ink supply device shown in FIG. 1.

FIG. 2 is a schematic diagram of the ink supply device 20.

As shown in FIG. 1 and FIG. 2, the ink supply device 20 is a device for supplying ink 10*c* to the recording heads 11*c* that discharge the ink 10*c*. It should be noted that, as the ink 10*c*, arbitrary ink may be employed, such as aqueous ink, latex ink, and solvent UV ink.

The ink supply device 20 includes replaceable ink containers 30 that are containers storing the deaerated ink 10*c*, and that are replaceable, bases 40 to and from which the replaceable ink containers 30 are attached and detached, carriage-mounting type ink supply devices 50 that are mounted on the carriage 11*b*, and that are for supplying the ink 10*c* to the recording heads 11*c* while controlling to maintain pressure of the ink 10*c* at a negative pressure within a predetermined range, and a tube 60 that forms a passage of the ink 10*c* between the bases 40 and the carriage-mounting type ink supply devices 50.

The replaceable ink containers 30, the bases 40, the carriage-mounting type ink supply devices 50, and the recording heads 11*c* have positions in a vertical direction that are descending in this order.

The replaceable ink containers 30 are large capacity containers, of which capacity is for example 2 liters.

The carriage-mounting type ink supplying devices 50 are arranged between the recording heads 11*c* and the replaceable ink containers 30 on the passage of the ink 10*c*.

Here, the replaceable ink containers 30 and the bases 40 are fixed relative to the main body 11, and do not move in the main scanning direction shown by the arrow 10*a*.

On the other hand, the recording heads 11*c* and the carriage-mounting type ink supply devices 50 are mounted on the carriage 11*b*, and are configured to move in the main scanning direction shown by the arrow 10*a* together with the carriage 11*b*.

The tube 60 has flexibility. Thus, even if the recording heads 11*c* and the carriage-mounting type ink supply devices 50 move in the direction shown by the arrow 10*a* relative to the replaceable ink containers 30 and the bases 40, a portion within the tube 60 on the passage of the ink 10*c* closer to the carriage-mounting type ink supply devices 50 deforms, and accordingly the ink 10*c* is supplied to the carriage-mounting type ink supply devices 50 from the bases 40 via the tube 60.

Figure 3:
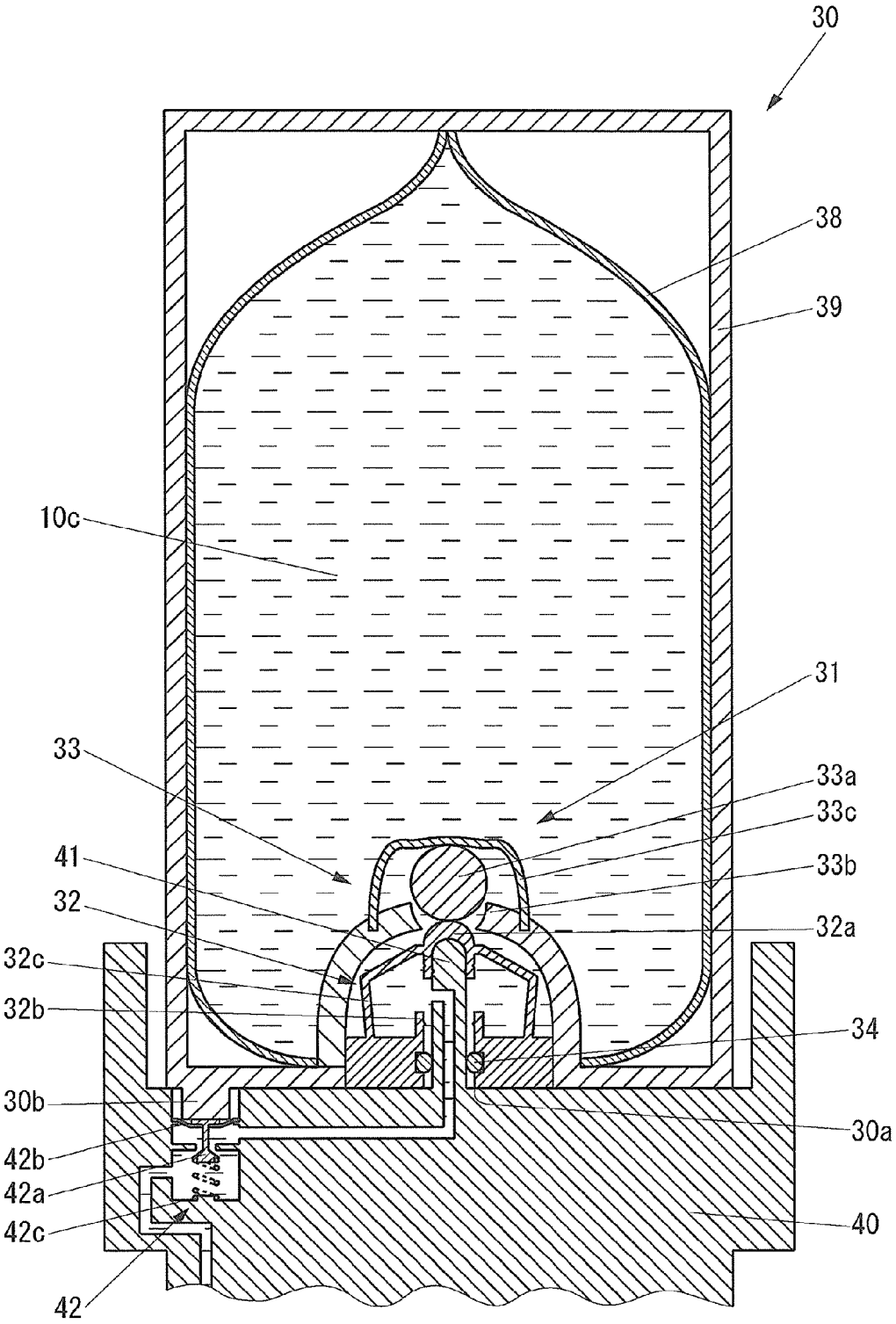
FIG. 3 is a front sectional view of a replaceable ink container shown in FIG. 2, in a case of having a male connector of a base inserted therein.
Figure 4:
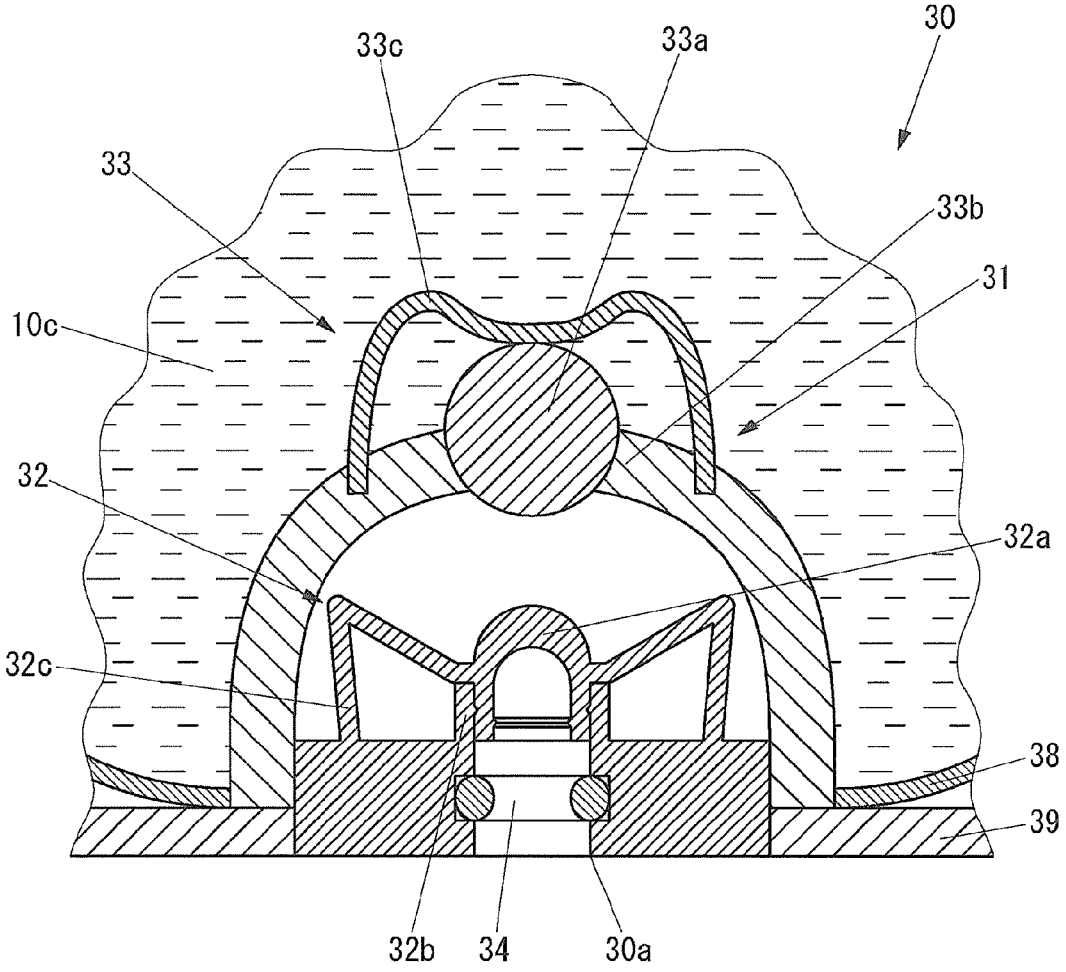
FIG. 4 is a front sectional view of a part of the replaceable ink container shown in FIG. 3, in a case of not having the male connector of the base inserted therein.
Figure 5:
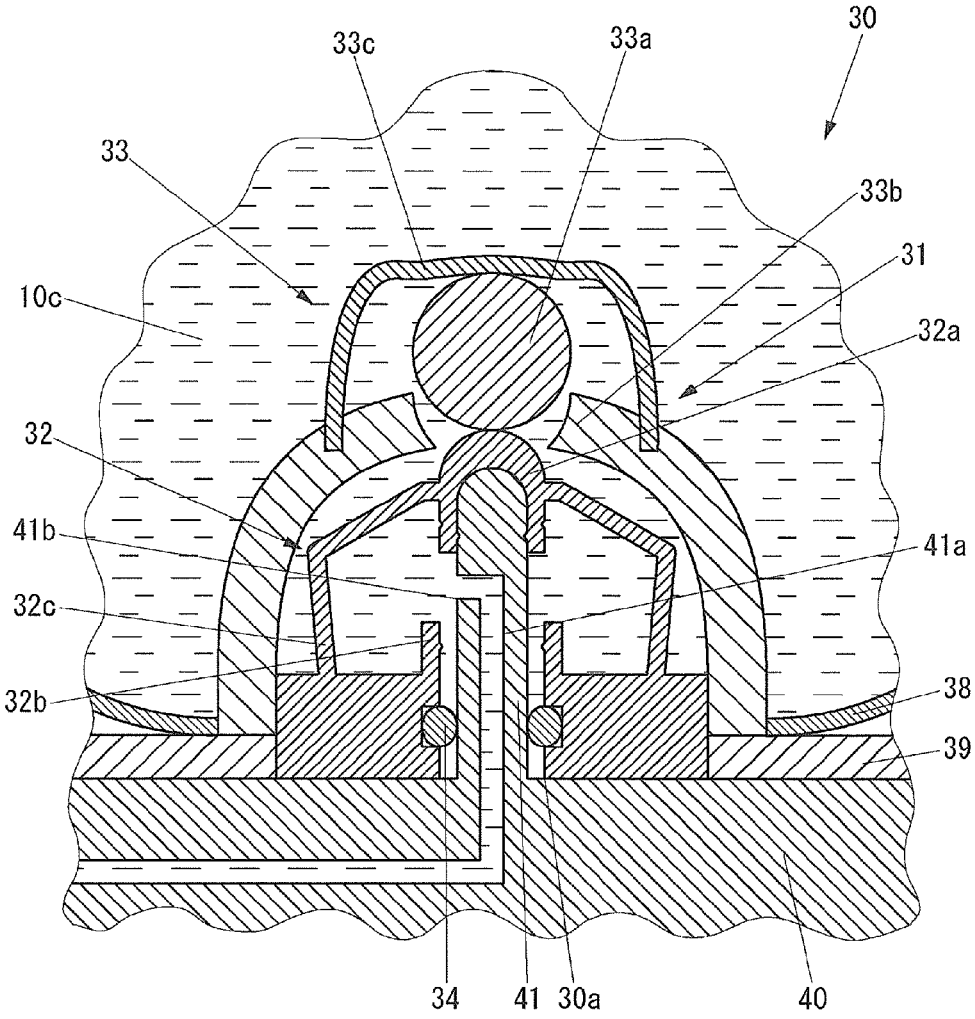
FIG. 5 is a front sectional view of a part of the replaceable ink container shown in FIG. 3, in a case of having the male connector of the base inserted therein.

FIG. 3 is a front sectional view of the replaceable ink container 30 in a case of having the male connector 41 of the base 40 inserted therein. FIG. 4 is a front sectional view of a part of the replaceable ink container 30 in a case of not having the male connector 41 of the base 40 inserted therein. FIG. 5 is a front sectional view of a part of the replaceable ink container 30 in the case of having the male connector 41 of the base 40 inserted therein.

As shown in FIG. 3 to FIG. 5, each replaceable ink container 30 includes an ink bag 38 for storing the ink 10*c* and a case 39 for suspending and housing the ink bag 38, and has an insertion opening 30*a* into which the male connector 41 of the base 40 is to be inserted formed thereon. The insertion opening 30*a* is provided on a lower side of the replaceable ink container 30, so that the ink 10*c* within the replaceable ink container 30 can be taken out to the last drip by self-weight of the ink 10*c*.

Further, the replaceable ink container 30 includes an opening plug 31 for plugging the insertion opening 30*a*.

The opening plug 31 includes an outer valve 32 and an inner valve 33 in an order from outer side toward inner side of the replaceable ink container 30. Further, the opening plug 31 includes an O-ring 34 for preventing the ink 10*c* from passing through between the outer valve 32 and the male connector 41 when the outer valve 32 is open.

The outer valve 32 includes an outer valve body 32*a* that is a valve body for opening and closing, a valve seat 32*b*, and a positioning member 32*c* that performs positioning of the outer valve body 32*a* relative to the valve seat 32*b*.

The outer valve body 32*a*, the valve seat 32*b*, and the positioning member 32*c* are configured of an identical member formed of plastic. The outer valve body 32*a* is configured capable of fit engaging with the male connector 41. The valve seat 32*b* is configured capable of fit engaging with the outer valve body 32*a*.

The outer valve 32 is a valve in which the outer valve body 32*a* is pressed by the male connector 41 and opened when the male connector 41 is inserted into the insertion opening 30*a*, and the outer valve body 32*a* closes by making contact with the male connector 41 when the male connector 41 is pulled out from the insertion opening 30*a*.

The positioning member 32*c* is formed in a thin and elongate shape so that it does not hinder the flow of the ink 10*c* supplied to the outside of the replaceable ink container 30 from within the replaceable ink container 30 through the outer valve 32.

The inner valve 33 includes an inner valve body 33*a* that is a valve body for opening and closing, a valve seat 33*b*, and a positioning member 33*c* that performs positioning of the inner valve body 33*a* relative to the valve seat 33*b*.

The inner valve body 33*a* is a sphere. The inner valve body 33*a* may be formed of metal such as stainless steel, and brass. The inner valve body 33*a* may be formed of coated metal, in which metal such as brass and iron is coated by plastic such as polyester, polyethylene, nylon, polyimide, and polyparaxylylene. The inner valve body 33*a* may be formed of plastic. The inner valve body 33*a* may be formed of a hybrid resin of plastic and inorganic substance.

The valve seat 33*b* and the positioning member 33*c* are formed of plastic.

The positioning member 33*c* not only has a positioning function for the inner valve body 33*a* relative to the valve seat 33*b*, but also a function of retaining the inner valve body 33*a* so as not to move to positions other than between a position shown in FIG. 4 and a position shown in FIG. 5. The positioning member 33*c* is formed in a thin and elongate shape so that it does not hinder the flow of the ink 10*c* supplied to the outside of the replaceable ink container 30 from within the replaceable ink container 30 through the inner valve 33.

The inner valve 33 is a valve in which the inner valve body 33*a* is pressed indirectly by the male connector 41 via the outer valve body 32*a* and opened when the male connector 41 is inserted into the insertion opening 30*a*, and the inner valve body 33*a* closes by receiving at least pressure of the ink 10*c* when the male connector 41 is pulled out from the insertion opening 30*a*.

Figure 6A:
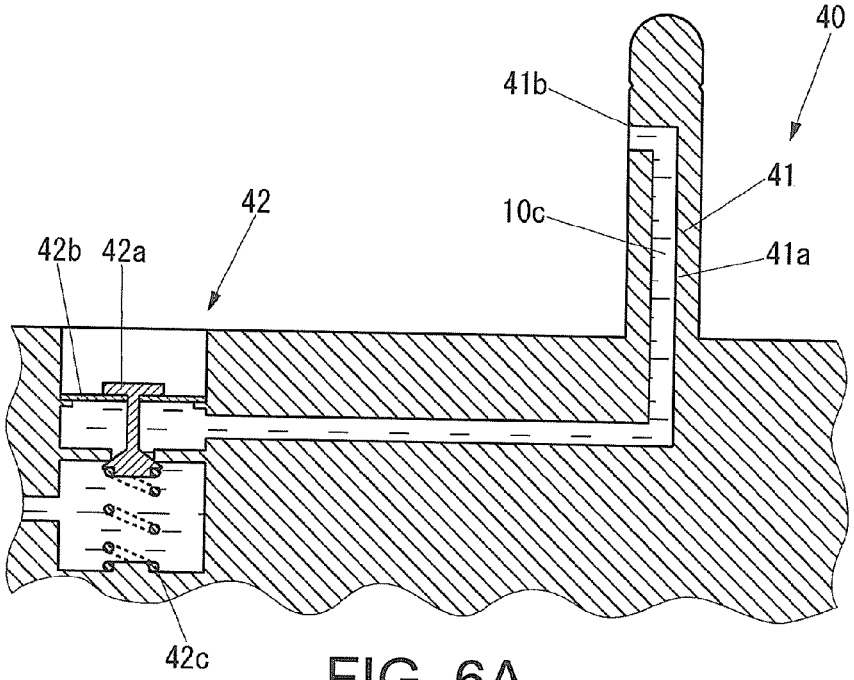
FIG. 6A is a cross sectional view of a part of the base shown in FIG. 3.
Figure 6B:
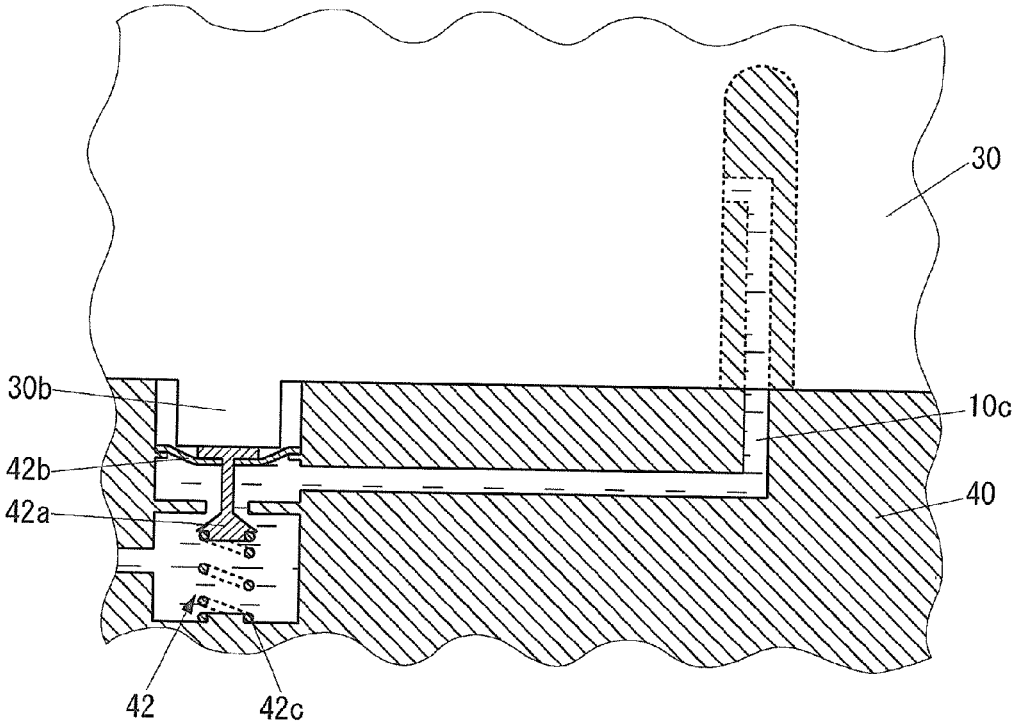
FIG. 6B is a cross sectional view of a part of the base shown in FIG. 3, in a case where the replaceable ink container is attached.

FIG. 6A is a cross sectional view of a part of the base 40. FIG. 6B is a cross sectional view of a part of the base 40 in a case where the replaceable ink container 30 is attached.

As shown in FIG. 6A and FIG. 6B, each base 40 includes the male connector 41 that is to be inserted into the replaceable ink container 30 so as to take out the ink 10*c* from the replaceable ink container 30, and a communicating valve 42 that communicates the replaceable ink container 30 and the tube 60 (see FIG. 2) in the passage of the ink 10*c*.

The male connector 41 has a passage 41*a* for the ink 10*c* formed therein. Further, the male connector 41 has an ink opening 41*b* for introducing the ink 10*c* to the passage 41*a* formed at a distal end portion.

The communicating valve 42 includes a valve body 42*a*, a diaphragm 42*b* supporting the valve body 42*a*, and a spring 42*c* biasing the valve body 42*a* in a direction along which the communicating valve 42 closes. The communicating valve 42 is a valve that opens by a protruding portion 30*b* of the replaceable ink container 30 pressing the valve body 42*a* when the replaceable ink container 30 is attached to the base 40.

Each base 40 can prevent air from being drawn into the passage of the ink 10*c* from the ink opening 41*b* of the male connector 41 when the replaceable ink container 30 is detached by the workings of the communicating valve 42 described above. Accordingly, the communicating valves 42 can prevent an occurrence of a defect by which discharge from the recording heads 11*c* becomes unstable by the air drawn into the passage of the ink 10*c*.

Figure 7:
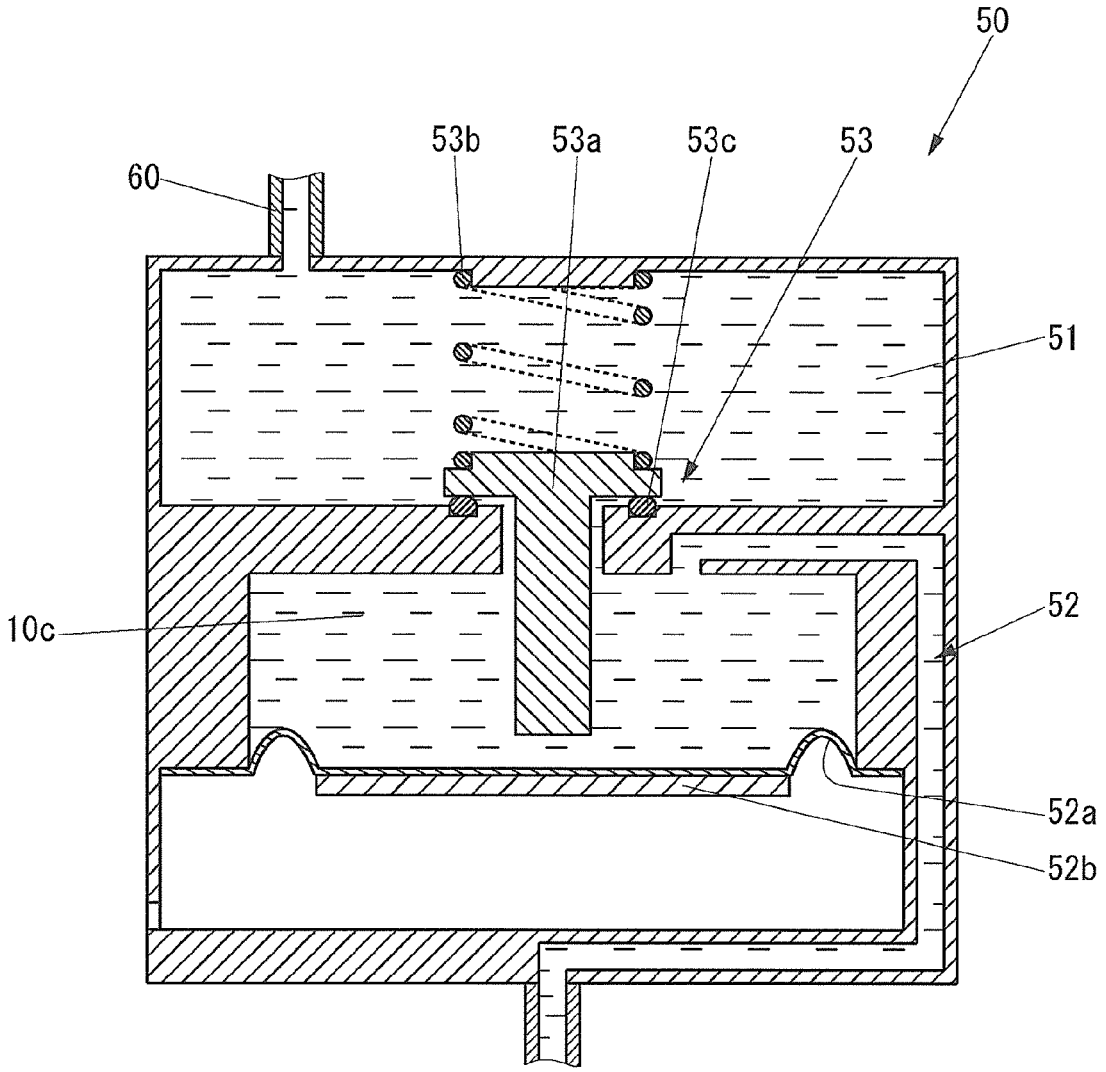
FIG. 7 is a cross sectional view of a carriage-mounting type ink supply device shown in FIG. 2.

FIG. 7 is a cross sectional view of a carriage-mounting type ink supply device 50.

As shown in FIG. 7, each carriage-mounting type ink supply device 50 includes an ink storage unit 51 that stores the ink 10*c*, a variable capacity ink storage unit 52 of which capacity can be changed according to the stored amount of the ink 10*c*, and a valve 53 for introducing the ink 10*c* from the ink storage unit 51 to the variable capacity ink storage unit 52.

The ink storage unit 51 is communicated with a replaceable ink container 30 (see FIG. 2) via the tube 60.

The variable capacity ink storage unit 52 is communicated with a recording head 11*c* (see FIG. 2). The variable capacity ink storage unit 52 includes a film 52*a* that deforms according to a change in capacity of the variable capacity ink storage unit 52, and a pressure receiving plate 52*b* that moves together with the change in the capacity of the variable capacity ink storage unit 52 and receives atmospheric pressure on one surface side.

The valve 53 includes a valve body 53*a*, a spring 53*b* that biases the valve body 53*a* in a direction along which the valve 53 closes, and an O-ring 53*c* for preventing the ink 10*c* from passing through the valve 53 when the valve 53 is closed. The valve 53 introduces the ink 10*c* from the ink storage unit 51 into the variable capacity ink storage unit 52 by the valve body 53*a* being pressed by the pressure receiving plate 52*b*.

The pressure receiving plate 52*b* is pressed in a direction along which the capacity of the variable capacity ink storage unit 52 increases, by the force received from the pressure of the ink 10*c* in the variable capacity ink storage unit 52 and the force of gravity that the pressure receiving plate 52*b* itself receives. Accordingly, when the valve 53 is closed, the pressure of the ink 10*c* in the variable capacity ink storage unit 52 is negative pressure.

Here, if the amount of the ink 10*c* in the variable capacity ink storage unit 52 decreases due to the ink 10*c* being discharged by the recording head 11*c*, the pressure receiving plate 52*b* is elevated accompanying the decrease in capacity of the variable capacity ink storage unit 52. When elevated, the pressure receiving plate 52*b* makes contact with the valve body 53*a* and opens the valve 53 by pushing up the valve body 53*a*. When the valve 53 is opened, the ink 10*c* is introduced into the variable capacity ink storage unit 52 from the ink storage unit 51 through the valve 53. When the ink 10*c* is introduced into the variable capacity ink storage unit 52, the capacity of the variable capacity ink storage unit 52 increases, so that the pressure receiving plate 52*b* descends, and the valve 53 is closed again.

The carriage-mounting type ink supply device 50 maintains the pressure of the ink 10*c* supplied to the recording head 11*c* as negative pressure within the predetermined range by the operation of the variable capacity ink storage unit 52 and the valve 53 as described above.

Next, functions of the opening plugs 31 of the replaceable ink containers 30 will be described.

In a case where the opening plug 31 is in a state shown in FIG. 4, each replaceable ink container 30 has both the outer valve 32 and the inner valve 33 closed. Accordingly, in the case where the opening plug 31 is in the state shown in FIG. 4, the replaceable ink container 30 can prevent the stored ink 10*c* from leaking out to outside through the insertion opening 30*a* by the inner valve 33. Further, in the case where the opening plug 31 is in the state shown in FIG. 4, the replaceable ink container 30 can prevent the stored ink 10*c* from leaking out to outside through the insertion opening 30*a* by the outer valve 32, even if the inner valve 33 happens to be opened.

When the replaceable ink container 30 is attached to the base 40, the male connector 41 of the base 40 is inserted into the insertion opening 30*a*. Then, the male connector 41 that has been inserted into the insertion opening 30*a* makes contact with the outer valve body 32*a* of the outer valve 32, and pushes up the outer valve body 32*a*. Here, if the outer valve 32 has been closed as shown in FIG. 4, the outer valve 32 opens by the outer valve body 32*a* being pushed up by the male connector 41, whereby the fit engagement of the outer valve body 32*a* and the valve seat 32*b* is released. When the outer valve body 32*a* is further pushed up by the male connector 41, the outer valve body 32*a* makes contact with the inner valve body 33*a* of the inner valve 33 and pushes up the inner valve body 33*a*. When the inner valve body 33*a* is indirectly pushed up by the male connector 41 via the outer valve body 32*a*, the inner valve 33 opens by the fit engagement of the inner valve body 33*a* and the valve seat 33*b* being released. That is, the replaceable ink container 30 has both the outer valve 32 and the inner valve 33 opened, and the opening plug 31 comes to be in a state shown in FIG. 5. Accordingly, the ink 10*c* in the replaceable ink container 30 becomes capable of being taken out to the outside via the opening plug 31 and the male connector 41.

Here, in the case where the replaceable ink container 30 is attached to the base 40, as shown in FIG. 6B, the communicating valve 42 of the base 40 is opened. Accordingly, of the ink 10*c* supplied to the carriage-mounting type ink supply device 50 via the base 40 and the tube 60 from the replaceable ink container 30, the recording head 11*c* can discharge the ink 10*c* of which pressure is maintained in negative pressure in the predetermined range by the carriage-mounting type ink supply device 50.

In a case where the opening plug 31 is in a state shown in FIG. 5, the replaceable ink container 30 normally has the male connector 41 of the base 40 fit engaged with the outer valve body 32*a* of the outer valve 32. Accordingly, in the case where the opening plug 31 is in the state shown in FIG. 5, when the replaceable ink container 30 is detached from the base 40, the male connector 41 of the base 40 is pulled down relative to the opening plug 31. Further, when the male connector 41 is pulled down relative to the opening plug 31, the outer valve body 32*a* that is fit engaged with the male connector 41 is pulled down by the male connector 41. When the outer valve body 32*a* is pulled down by the male connector 41, the inner valve body 33*a* that has been pushed up by the outer valve body 32*a* is pressed downward by the pressure of the ink 10*c*, so that it moves downward accompanying the movement of the outer valve body 32*a* by making contact with the outer valve body 32*a*. Then, the inner valve 33 is closed by the inner valve body 33*a* fit engaging with the valve seat 33*b*. When the outer valve body 32*a* is further pulled down by the male connector 41, the outer valve 32 closes by the outer valve body 32*a* fit engaging with the valve seat 32*b*. When the male connector 41 is further pulled down relative to the opening plug 31, it is pulled out from the insertion opening 30*a* by the fit engagement with the outer valve body 32*a* that is fit engaged with the valve seat 32*b* being released. That is, the replaceable ink container 30 has both the outer valve 32 and the inner valve 33 closed, and the opening plug 31 returns to the state shown in FIG. 4.

Figure 8:
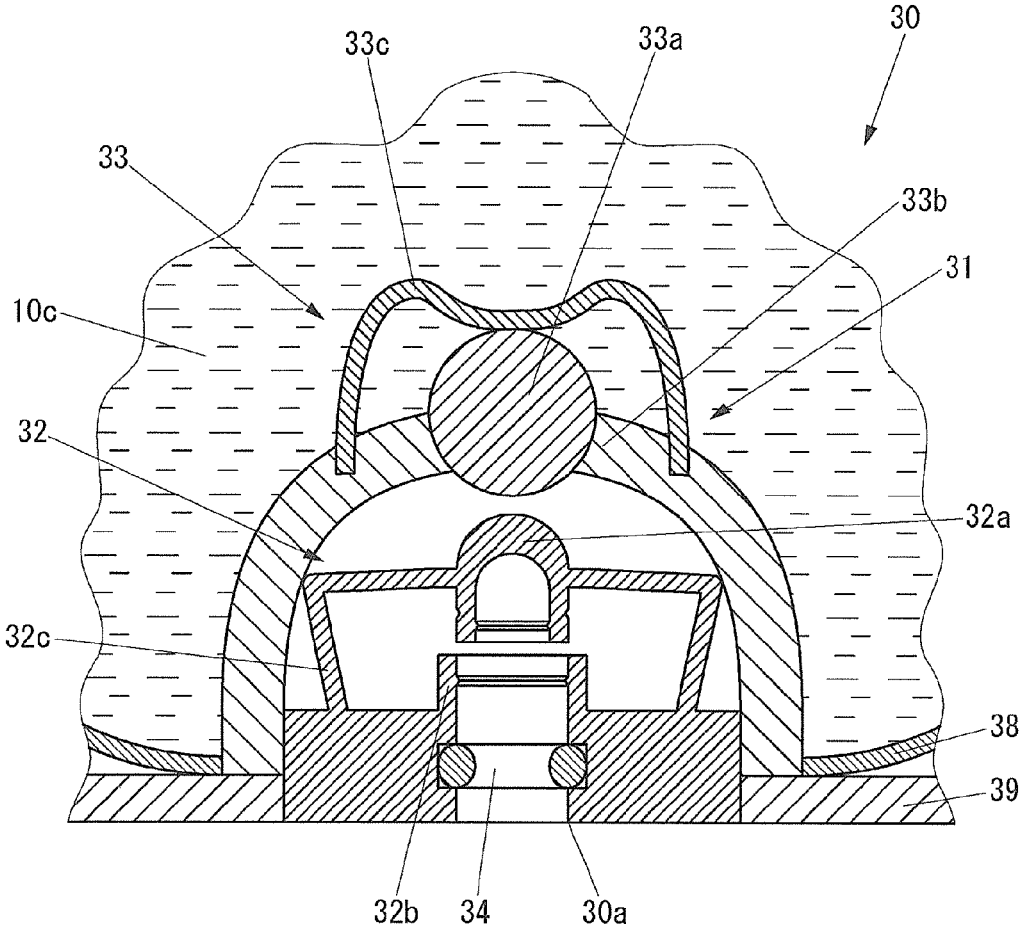
FIG. 8 is a front sectional view of a part of the replaceable ink container shown in FIG. 3 in a case where an outer valve is open.

Here, even if the opening plug 31 is in the state shown in FIG. 5, in the case where the replaceable ink container 30 may for example have an insufficient fit engagement between the male connector 41 of the base 40 and the outer valve body 32*a* of the outer valve 32, or have a foreign matter stuck between the outer valve body 32*a* of the outer valve 32 and the valve seat 32*b*, if it is detached from the base 40 and the male connector 41 of the base 40 is pulled down relative to the opening plug 31, the outer valve 32 may not be sealed as shown in FIG. 8. However, even in the case where the opening plug 31 is in the state shown in FIG. 8, the replaceable ink container 30 has the inner valve 33 closed, so that the stored ink 10*c* can be prevented from leaking out to outside through the insertion opening 30*a* by the inner valve 33.

As described above, the ink supply device 20 can reduce the possibility that the ink 10*c* may leak from the replaceable ink containers 30 compared to in the conventional configuration, since the inner valves 33 receiving the pressure of the ink 10*c* automatically close even when the outer valves 32, which are supposed to be sealed, are not sealed due to a defect in the event where the male connectors 41 of the bases 40 are pulled out from the replaceable ink containers 30.

It should be noted that, as a case where the male connectors 41 are pulled out from the replaceable ink containers 30 in a state where the ink 10*c* still remains in the replaceable ink containers 30, for example, there may be a case where the type of the ink 10*c* to be used by the inkjet printer 10 needs to be changed, or a case where replaceable ink containers 30 storing cleansing liquid are to be attached to the bases 40 instead of the replaceable ink containers 30 storing the ink 10*c*, in order to cleanse the passage of the ink 10*c* from the bases 40 to nozzles that are not shown in the recording heads 11*c*.

The inner valves 33 of the replaceable ink containers 30 may be valves to which closing force by self-weight of the inner valve bodies 33*a* is applied when the male connectors 41 of the bases 40 are pulled out from the insertion openings 30*a* of the replaceable ink containers 30. For example, in a case where the inner valve bodies 33*a* are formed of a material with large specific gravity, such as metal or coated metal, the closing force is applied by their self-weight. According to this configuration, the ink supply device 20 can improve certainty that the inner valves 33 will be closed, due to the closing force being applied to the inner valves 33 not only by the pressure of the ink 10*c* but also by the self-weight of the inner valve bodies 33*a* upon when the male connectors 41 are pulled out from the replaceable ink containers 30.

Further, the inner valve 33 of each replaceable ink container 30 may be configured such that the positioning member 33*c* may function as a biasing unit that biases the inner valve body 33*a* in the direction along which the inner valve body 33*a* closes. That is, the positioning member 33*c* may be an elastic body. According to this configuration, the ink supply device 20 can improve the certainty that the inner valves 33 will be closed, since the closing force is applied to the inner valves 33 not only by the pressure of the ink 10*c* but also by the biasing force by the positioning members 33*c* upon when the male connectors 41 are pulled out from the replaceable ink containers 30. This configuration is effective regardless of the material of the inner valve bodies 33*a*, however, it is especially effective in a case where the inner valve bodies 33*a* are formed of a material with light specific gravity such as plastic, to which no closing force by self-weight is applied.

Further, in the outer valve 32 of each replaceable ink container 30, the positioning member 32*c* may have a function of biasing the outer valve body 32*a* in the direction along which the outer valve body 32*a* closes. That is, the positioning member 32*c* may be an elastic body.

The shape of the outer valves 32 may be those other than the shape shown in this embodiment. As the outer valves 32, publicly known arbitrary valves may be employed so long as they are valves that are opened and closed by the insertion and pull-out of the male connectors 41.

Figure 9:
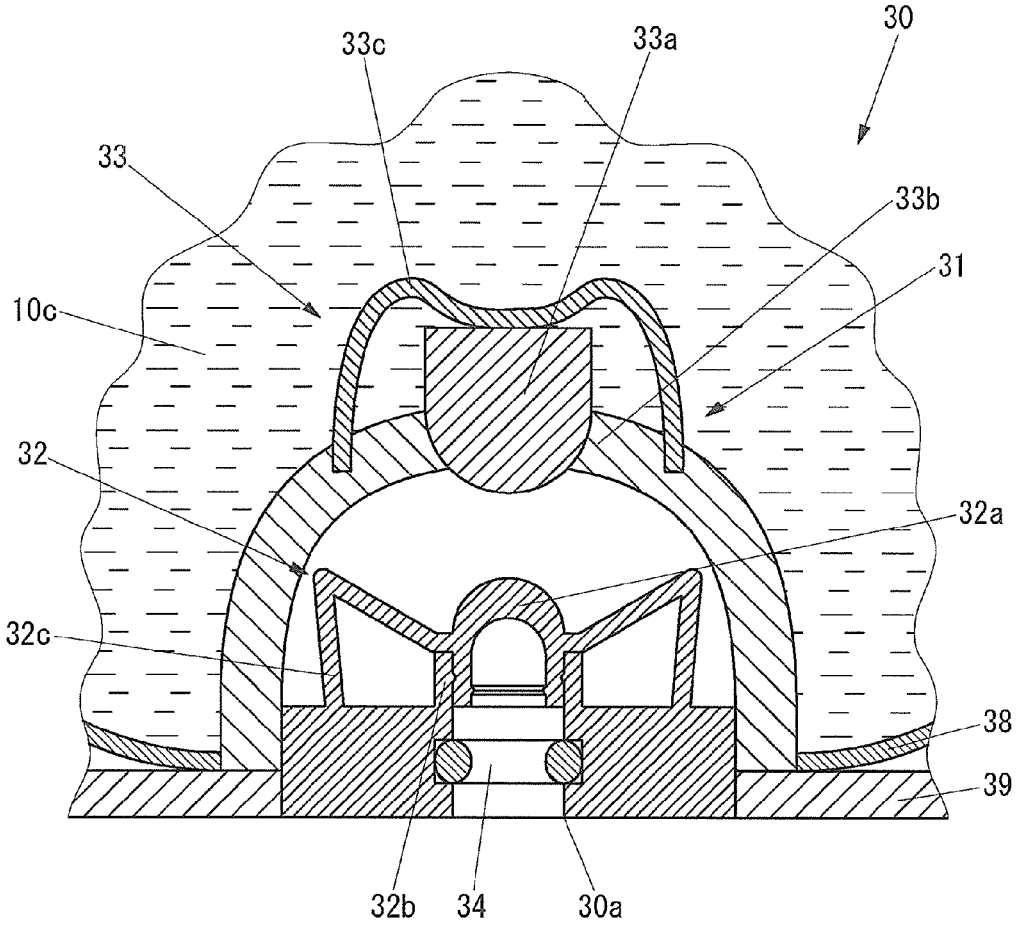
FIG. 9 is a front sectional view of a part of the replaceable ink container shown in FIG. 2 in an example different from the example shown in FIG. 4.

The shape of the inner valves 33 may be those other than the shape shown in this embodiment. As the inner valves 33, arbitrary valves may be employed so long as they are valves that are opened and closed by the insertion and pull-out of the male connectors 41. For example, the shape of the inner valve bodies 33*a* of the inner valves 33 may be a columnar shape having one end in a semispherical shape as shown in FIG. 9, or may be conical, or conical frustum shape. Similarly, arbitrary shape may be employed as the shape of the valve seats 33*b* of the inner valves 33.

Second Embodiment

Firstly, a configuration of an inkjet printer according to the present embodiment will be described.

It should be noted that, among configurations of the inkjet printer according to the present embodiment, configurations that are similar to the configurations of the inkjet printer 10 (see FIG. 1) according to the first embodiment will be given the same reference signs as the inkjet printer 10, and detailed descriptions thereof will be omitted.

Figure 10:
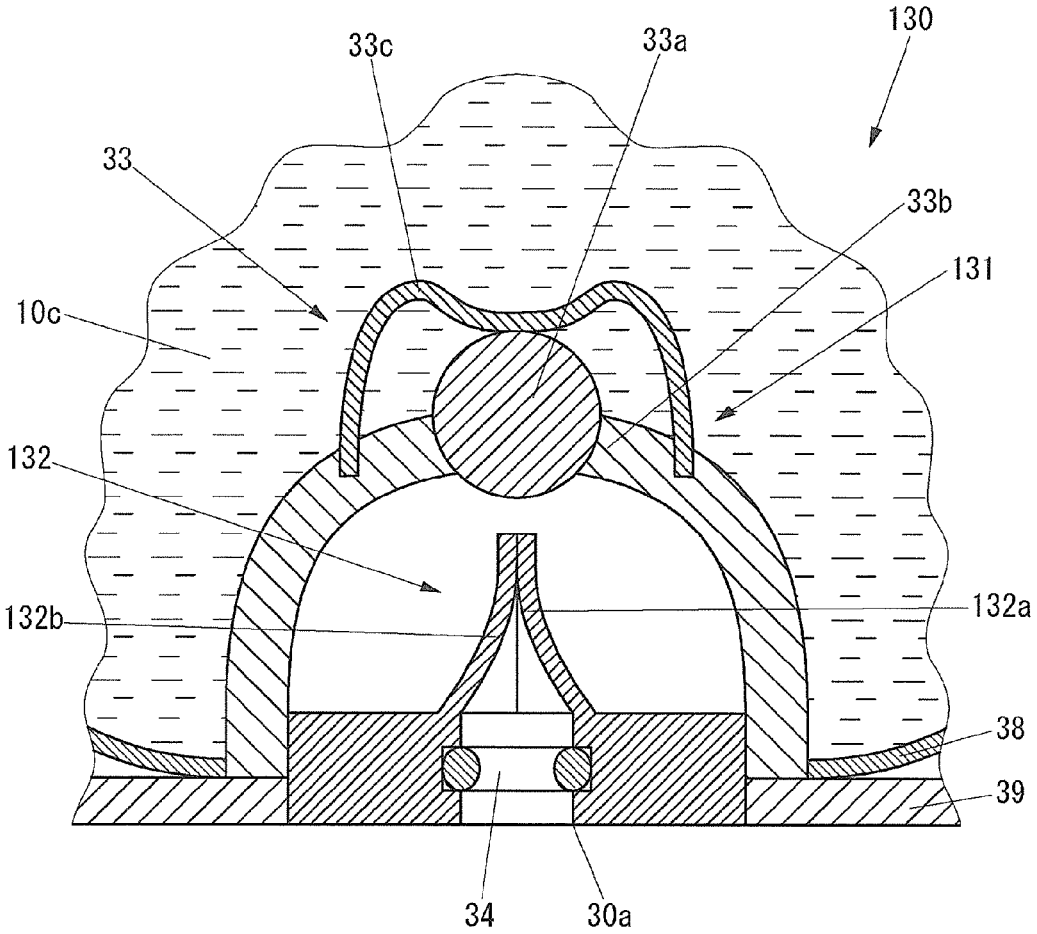
FIG. 10 is a front sectional view of a part of a replaceable ink container of an inkjet printer according to a second embodiment of the present invention.
Figure 11:
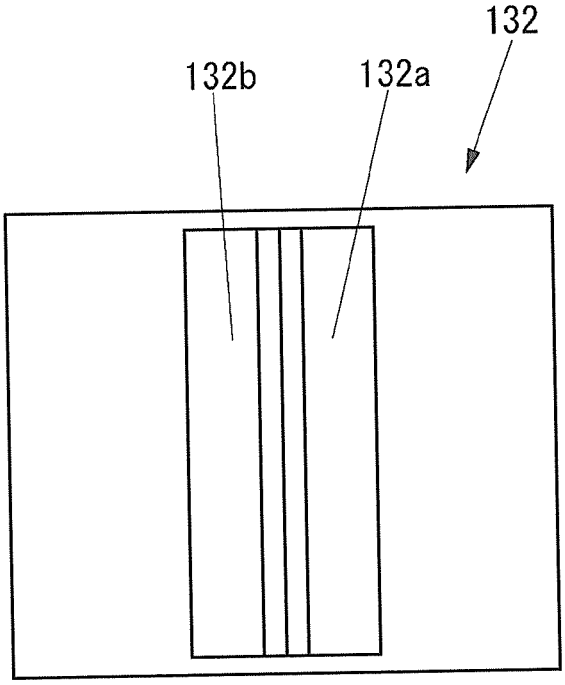
FIG. 11 is a plan view of an outer valve of the replaceable ink container in a state shown in FIG. 10.
Figure 12:
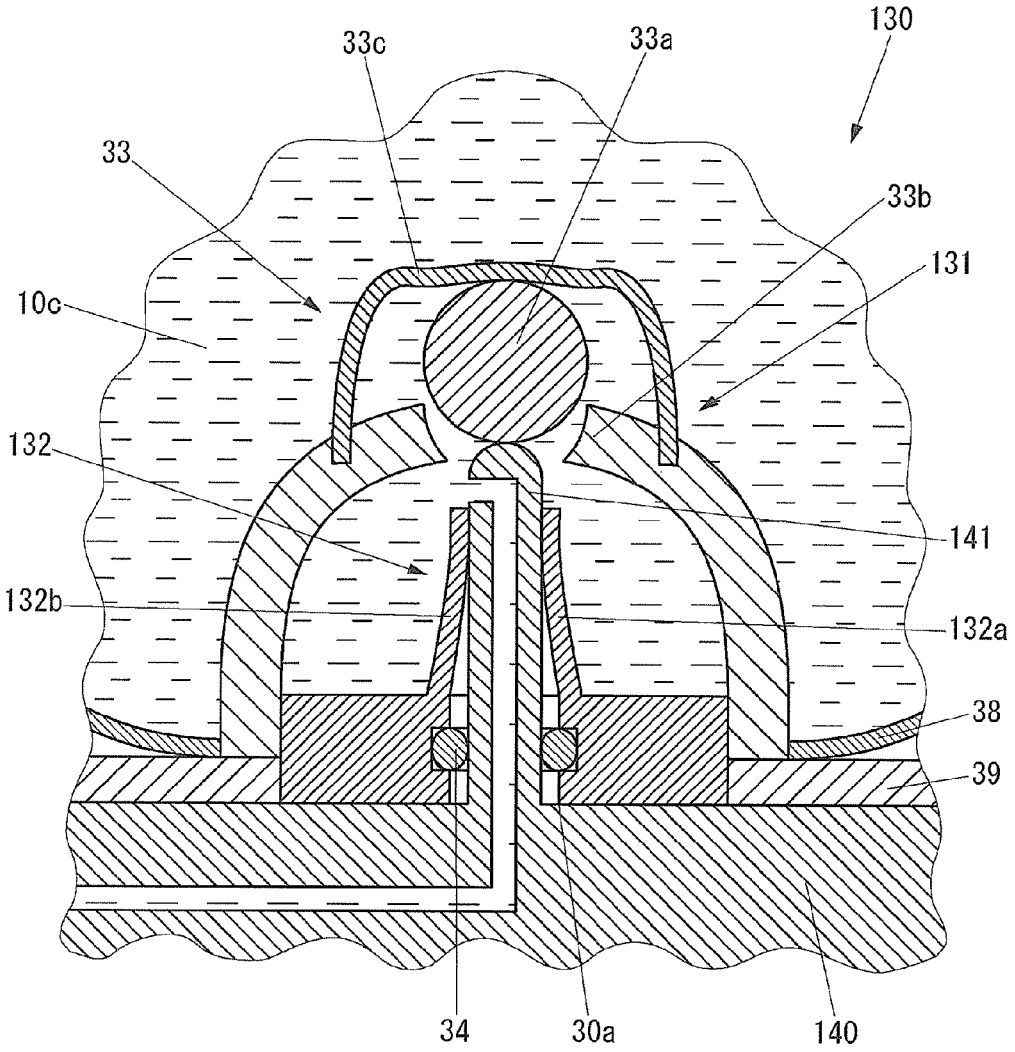
FIG. 12 is a front sectional view of a part of the replaceable ink container shown in FIG. 10 in a case where a male connector of a base is inserted therein.
Figure 13:
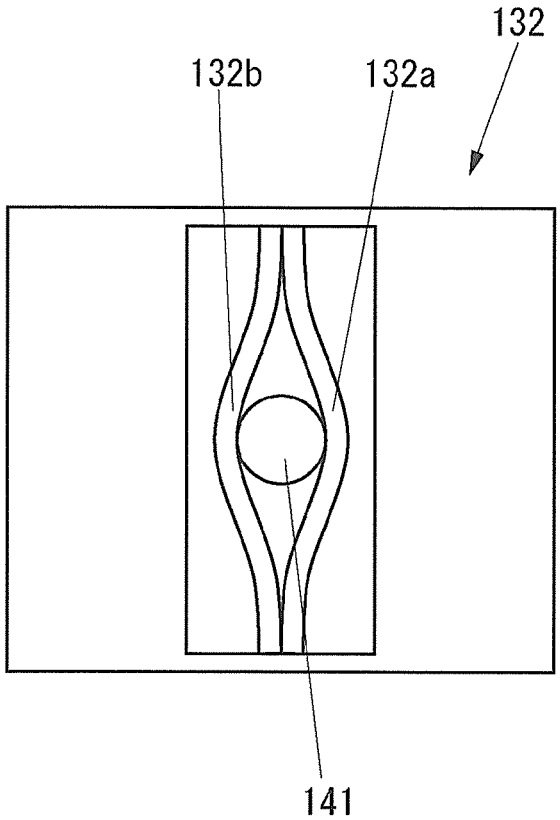
FIG. 13 is a plan view of the outer valve of the replaceable ink container in a state shown in FIG. 12.

FIG. 10 is a front sectional view of a part of a replaceable ink container 130 of an inkjet printer according to the present embodiment. FIG. 11 is a plan view of an outer valve 132 of the replaceable ink container 130 in a state shown in FIG. 10. FIG. 12 is a front sectional view of a part of the replaceable ink container 130 in a case of having a male connector 141 of a base 140 inserted therein. FIG. 13 is a plan view of an outer valve 132 of the replaceable ink container 130 in a state shown in FIG. 12.

The configuration of the inkjet printer according to the present embodiment is similar to a configuration in which the inkjet printer 10 includes a replaceable ink container 130 and a base 140 shown in FIG. 10 to FIG. 13 instead of the replaceable ink container 30 (see FIG. 4 and FIG. 5) and the base 40 (see FIG. 5).

A configuration of the replaceable ink container 130 is similar to a configuration in which the replaceable ink container 30 includes an opening plug 131 instead of the opening plug 31 (see FIG. 4 and FIG. 5).

A configuration of the opening plug 131 is similar to a configuration in which the opening plug 31 includes an outer valve 132 being a reed valve instead of the outer valve 32 (see FIG. 4 and FIG. 5).

The outer valve 132 includes a pair of outer valve bodies 132*a*, 132*b* being valve bodies for opening and closing.

Each of the pair of outer valve bodies 132*a*, 132*b* is a film-shaped member formed of flexible plastic. The outer valve 132 is a valve to which closing force is applied by rigidity of the pair of outer valve bodies 132*a*, 132*b* themselves, when a male connector 141 is pulled out from an insertion opening 30*a*. The outer valve bodies 132*a*, 132*b* have their entireties of both end portions in a direction vertical to an inserting direction of the male connector 141 into the insertion opening 30*a*, or at least their base-side portions within the both end portions adhered to each other.

As shown in FIG. 12 and FIG. 13, a configuration of a base 140 is similar to a configuration in which the male connector 141 is provided in the base 40 instead of the male connector 41 (see FIG. 5).

A configuration of the male connector 141 is similar to a configuration in which a groove for fit engaging with the outer valve body 32*a* (see FIG. 5) of the outer valve 32 (see FIG. 5) is not formed on the male connector 41.

Next, functions of the opening plug 131 of the replaceable ink container 130 will be described.

When the opening plug 131 is in a state shown in FIG. 10 and FIG. 11, the replaceable ink container 130 has both the outer valve 132 and the inner valve 33 closed. Accordingly, in the case where the opening plug 131 is in the state shown in FIG. 10 and FIG. 11, the replaceable ink container 130 can prevent the stored ink 10*c* from leaking out to outside through the insertion opening 30*a* by the inner valve 33. Further, in the case where the opening plug 131 is in the state shown in FIG. 10 and FIG. 11, the replaceable ink container 130 can prevent the stored ink 10*c* from leaking out to outside through the insertion opening 30*a* by the outer valve 132, even if the inner valve 33 happens to be opened.

When the replaceable ink container 130 is attached to the base 140, the male connector 141 of the base 140 is inserted into the insertion opening 30*a*. Then, the male connector 141 that has been inserted into the insertion opening 30*a* makes contact with the pair of outer valve bodies 132*a*, 132*b* of the outer valve 132, and pushes the outer valve body 132*a* and the outer valve body 132*b* apart. Here, if the outer valve 132 has been closed as shown in FIG. 10 and FIG. 11, the outer valve 132 opens by the outer valve body 132*a* and the outer valve body 132*b* being pushed apart by the male connector 141. When the male connector 141 is further inserted, it makes contact with the inner valve body 33*a* of the inner valve 33, and pushes up the inner valve body 33*a*. When the inner valve body 33*a* is directly pushed up by the male connector 141, the inner valve 33 opens by the fit engagement of the inner valve body 33*a* and a valve seat 33*b* being released. That is, the replaceable ink container 130 has both the outer valve 132 and the inner valve 33 opened, and the opening plug 31 comes to be in a state shown in FIG. 12 and FIG. 13. Accordingly, the ink 10*c* in the replaceable ink container 130 becomes capable of being taken out to the outside via the opening plug 131 and the male connector 141.

In the case where the opening plug 131 is in the state shown in FIG. 12 and FIG. 13, when the replaceable ink container 130 is detached from the base 140, the male connector 141 of the base 140 is pulled down relative to the opening plug 131. Further, when the male connector 141 is pulled down relative to the opening plug 131, the inner valve body 33*a* that has been pushed up by the male connector 141 is pressed downward by the pressure of the ink 10*c*, so that it moves downward accompanying the movement of the male connector 141 by making contact with the male connector 141. Then, the inner valve 33 is closed by the inner valve body 33*a* fit engaging with the valve seat 33*b*. When the male connector 141 is further pulled down, the outer valve 132 is closed by the male connector 141 being pulled out from between the outer valve body 132*a* and the outer valve body 132*b*. When the male connector 141 is further pulled down relative to the opening plug 131, it is pulled out of the insertion opening 30*a*. That is, the replaceable ink container 130 has both the outer valve 132 and the inner valve 33 closed, and the opening plug 131 returns to the state shown in FIG. 10 and FIG. 11.

Here, even if the opening plug 131 is in the state shown in FIG. 12 and FIG. 13, the replaceable ink container 130 may for example not be sealed, when it is detached from the base 140 and the male connector 141 of the base 140 is pulled down relative to the opening plug 131, in the case where a foreign matter is stuck between the outer valve body 132*a* and the outer valve body 132*b* of the outer valve 132. However, even in the case where the outer valve 132 is in the state of not being sealed, the replaceable ink container 130 has the inner valve 33 closed, so that the stored ink 30*c* can be prevented from leaking out to outside through the insertion opening 30*a* by the inner valve 33.

As described above, the ink supply device of the present embodiment can reduce the possibility that the ink 10*c* may leak from the replaceable ink containers 130 compared to in the conventional configuration, since the inner valves 33 receiving the pressure of the ink 10*c* automatically close even when the outer valves 132, which are supposed to be sealed, are not sealed due to a defect in the event where the male connectors 141 of the bases 140 are pulled out from the replaceable ink containers 130.

Further, the ink supply device according to the present embodiment can improve certainty that the outer valves 132 will close, since the outer valves 132 are automatically closed by the closing force being applied by the rigidity of the pair of outer valve bodies 132*a*, 132*b* themselves in the case where the male connectors 141 are pulled out from the replaceable ink containers 130.

Third Embodiment

Firstly, a configuration of an inkjet printer according to the present embodiment will be described.

It should be noted that, among configurations of the inkjet printer according to the present embodiment, configurations that are similar to the configurations of the inkjet printer according to the second embodiment will be given the same reference signs as the inkjet printer according to the second embodiment, and detailed descriptions thereof will be omitted.

Figure 14:
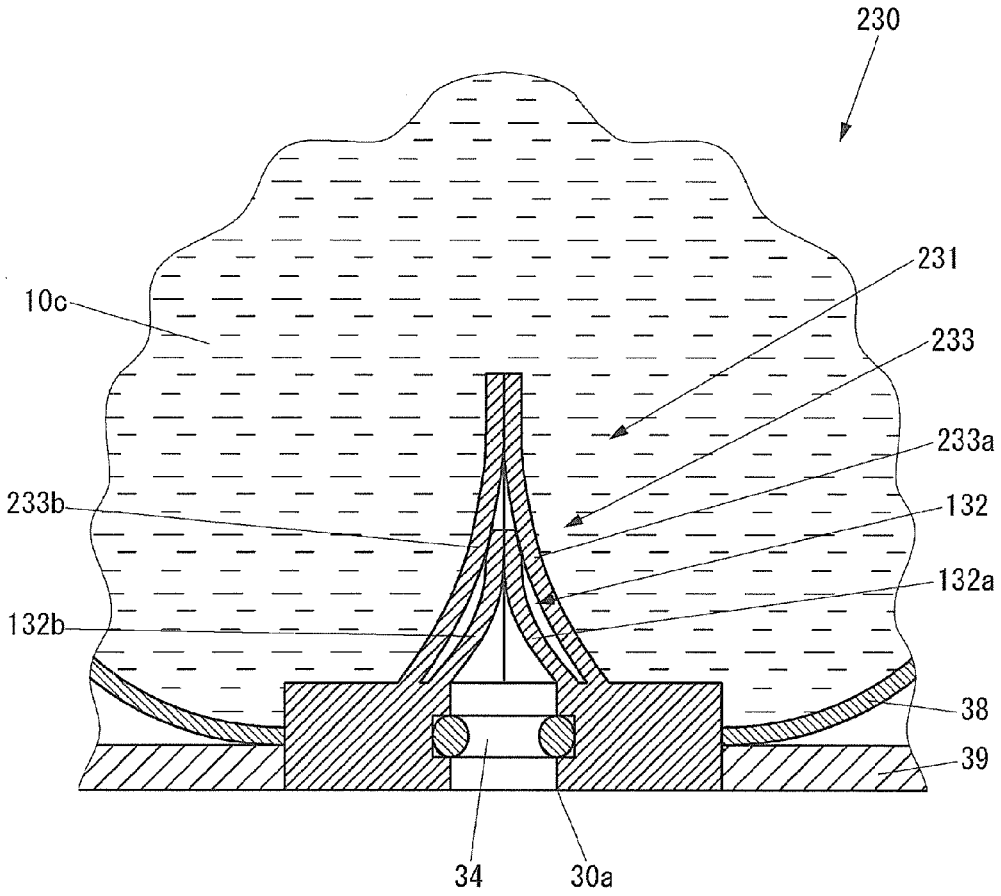
FIG. 14 is a front sectional view of a part of a replaceable ink container of an inkjet printer according to a third embodiment of the present invention.
Figure 15:
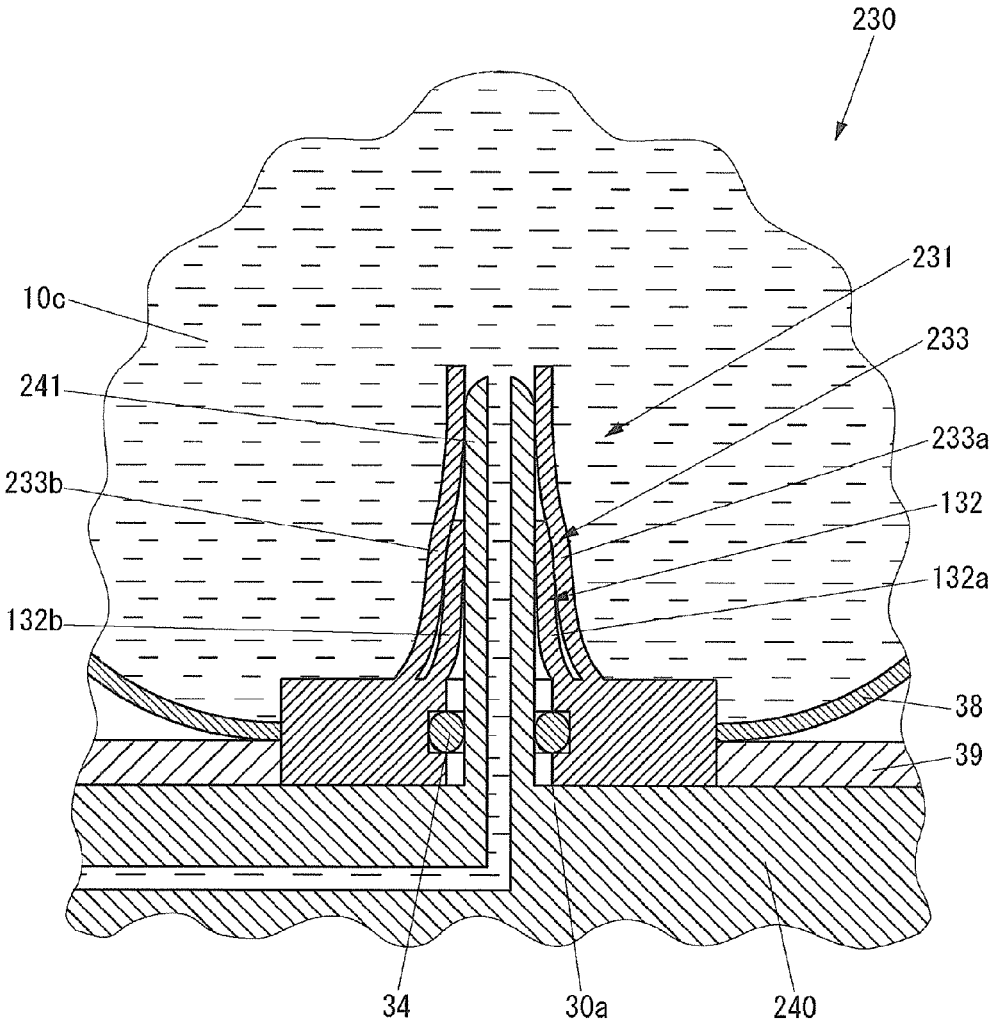
FIG. 15 is a front sectional view of a part of the replaceable ink container shown in FIG. 14 in a case where a male connector of a base is inserted therein.

FIG. 14 is a front sectional view of a part of a replaceable ink container 230 of the inkjet printer according to the present embodiment. FIG. 15 is a front sectional view of a part of the replaceable ink container 230 in a case of having a male connector 241 of a base 240 inserted therein.

The configuration of the inkjet printer according to the present embodiment is similar to a configuration in which the inkjet printer according to the second embodiment includes a replaceable ink container 230 and a base 240 shown in FIG. 14 and FIG. 15 instead of the replaceable ink container 130 (see FIG. 10 and FIG. 12) and the base 140 (see FIG. 12).

A configuration of the replaceable ink container 230 is similar to a configuration in which the replaceable ink container 130 includes an opening plug 231 instead of the opening plug 131 (see FIG. 10 and FIG. 12).

A configuration of the opening plug 231 is similar to a configuration in which the opening plug 131 includes an inner valve 233 being a reed valve instead of the inner valve 33 (see FIG. 10 and FIG. 12).

The inner valve 233 includes a pair of inner valve bodies 233*a*, 233*b* being valve bodies for opening and closing.

Each of the pair of inner valve bodies 233*a*, 233*b* is a film-shaped member formed of flexible plastic. The inner valve 233 is a valve to which closing force is applied by rigidity of the pair of inner valve bodies 233*a*, 233*b* themselves, when a male connector 241 is pulled out from an insertion opening 30*a*. The inner valve bodies 233*a*, 233*b* have their entireties of both end portions in a direction vertical to an inserting direction of the male connector 241 into the insertion opening 30*a*, or at least their base-side portions within the both end portions adhered to each other.

As shown in FIG. 15, a configuration of a base 240 is similar to a configuration in which the male connector 241 is provided in the base 140 instead of the male connector 141 (see FIG. 12).

The male connector 241 differs from the male connector 141 only in a shape of a passage for the ink 10*c*.

Next, functions of the opening plugs 231 of the replaceable ink containers 230 will be described.

In a case where the opening plug 231 is in a state shown in FIG. 14, each replaceable ink container 230 has both the outer valve 132 and the inner valve 233 closed. Accordingly, in the case where the opening plug 231 is in the state shown in FIG. 14, the replaceable ink container 230 can prevent the stored ink 10*c* from leaking out to outside through the insertion opening 30*a* by the inner valve 233. Further, in the case where the opening plug 231 is in the state shown in FIG. 14, the replaceable ink container 230 can prevent the stored ink 10*c* from leaking out to outside through the insertion opening 30*a* by the outer valve 132, even if the inner valve 233 happens to be opened.

When the replaceable ink container 230 is attached to the base 240, the male connector 241 of the base 240 is inserted into the insertion opening 30*a*. Then, the male connector 241 that has been inserted into the insertion opening 30*a* makes contact with the pair of outer valve bodies 132*a*, 132*b* of the outer valve 132, and pushes the outer valve body 132*a* and the outer valve body 132*b* apart. Here, if the outer valve 132 has been closed as shown in FIG. 14, the outer valve 132 opens by the outer valve body 132*a* and the outer valve body 132*b* being pushed apart by the male connector 241. When the male connector 241 is further inserted, it makes contact with a pair of inner valve bodies 233*a*, 233*b* of the inner valve 233, and pushes the inner valve body 233*a* and the inner valve body 233*b* apart. Here, if the inner valve 233 has been closed as shown in FIG. 14, the inner valve 233 opens by the inner valve body 233*a* and the inner valve body 233*b* being pushed apart by the male connector 241. That is, the replaceable ink container 230 has both the outer valve 132 and the inner valve 233 opened, and the opening plug 231 comes to be in a state shown in FIG. 15. Accordingly, the ink 10*c* in the replaceable ink container 230 becomes capable of being taken out to the outside via the opening plug 231 and the male connector 241.

In the case where the opening plug 231 is in the state shown in FIG. 15, when the replaceable ink container 230 is detached from the base 240, the male connector 241 of the base 240 is pulled down relative to the opening plug 231. When the male connector 241 is pulled down relative to the opening plug 231, the inner valve 233 closes by the male connector 241 being pulled out from between the inner valve body 233*a* and the inner valve body 233*b*. When the male connector 241 is further pulled down, the outer valve 132 is closed by the male connector 241 being pulled out from between the outer valve body 132*a* and the outer valve body 132*b*. When the male connector 241 is further pulled down relative to the opening plug 231, it is pulled out of the insertion opening 30*a*. That is, the replaceable ink container 230 has both the outer valve 132 and the inner valve 233 closed, and the opening plug 231 returns to the state shown in FIG. 14.

Here, even if the opening plug 231 is in the state shown in FIG. 15, the replaceable ink container 230 may for example not be sealed, when it is detached from the base 240 and the male connector 241 of the base 240 is pulled down relative to the opening plug 231, in the case where a foreign matter is stuck between the outer valve body 132*a* and the outer valve body 132*b*. However, even in the case where the outer valve 132 is in the state of not being sealed, the replaceable ink container 230 has the inner valve 233 closed, so that the stored ink 10*c* can be prevented from leaking out to outside through the insertion opening 30*a* by the inner valve 233.

As described above, the ink supply device according to the present embodiment can reduce the possibility that the ink 10*c* may leak from the replaceable ink containers 230 compared to in the conventional configuration, since the inner valves 233 receiving the pressure of the ink 10*c* automatically close even when the outer valves 132, which are supposed to be sealed, are not sealed due to a defect in the event where the male connectors 241 of the bases 240 are pulled out from the replaceable ink containers 230.

Further, the ink supply device according to the present embodiment can improve certainty that the outer valves 132 will close, since the outer valves 132 are automatically closed by the closing force being applied by the rigidity of the pairs of outer valve bodies 132*a*, 132*b* themselves in the case where the male connectors 241 are pulled out from the replaceable ink containers 230.

Further, the ink supply device according to the present embodiment can improve certainty that the inner valves 233 will close, since the inner valves 233 are automatically closed by the closing force being applied by the rigidity of the pairs of inner valve bodies 233*a*, 233*b* themselves in the case where the male connectors 241 are pulled out from the replaceable ink containers 230.

It should be noted that, in the second embodiment, a configuration in which only the outer valve, among the inner valve and the outer valve of the opening plug of the replaceable ink container, is a reed valve has been described. Further, in the third embodiment, a configuration in which both the inner valve and the outer valve of the opening plug of the replaceable ink container are reed valves has been described. A detailed description for a configuration in which only the inner valve, among the inner valve and the outer valve of the opening plug of the replaceable ink container, is a reed valve will be omitted, however, workings and effects similar to those of the second embodiment or the third embodiment can be achieved.

In the inkjet printers in the respective embodiments as described above, the replaceable ink containers and the bases are fixed relative to the main body and do not move in the main scanning direction, however, they may be mounted on the carriage 11*b* and be movable together with the carriage 11*b* in the main scanning direction.

The inkjet printers in the respective embodiments as described above are printers with a scheme in which, as shown in FIG. 1, printing in the main scanning direction by the recording heads 11*c* is carried out by moving the recording heads 11*c* in the main scanning direction by the carriage 11*b* relative to the recording medium 90 that does not move in the main scanning direction, and a position of the recording heads 11*c* relative to the recording medium 90 in the sub scanning direction is changed by transferring the recording medium 90 in the sub scanning direction relative to the recording heads 11*c* that do not move in the sub scanning direction, each time the printing in the main scanning direction is finished. However, the inkjet printers may be printers with schemes other than the scheme in the respective embodiments as described above. For example, the inkjet printers may be printers with a scheme in which printing in the main scanning direction by the recording heads 11*c* is carried out by moving the recording heads 11*c* in the main scanning direction by the carriage 11*b* relative to the recording medium 90 that does not move by being mounted on a table, and a position of the recording heads 11*c* relative to the recording medium 90 in the sub scanning direction is changed by moving the main body 11 in the sub scanning direction relative to the table on which the recording medium 90 is mounted, each time the printing in the main scanning direction is finished.

Furthermore, as ink discharging schemes in the inkjet printers according to the respective embodiments as described above, arbitrary schemes may be employed. For example, they may be of a valve jet scheme that depicts images by controlling ink discharges by opening and closing of a valve.

The invention claimed is:

1. An ink supply device for supplying an ink to a recording head for discharging the ink in an inkjet printer, the ink supply device comprising:

a replaceable ink container being a container for storing the ink and being replaceable; and a male connector to be inserted into the replaceable ink container to take out the ink from the replaceable ink container, wherein the replaceable ink container has an insertion opening where the male connector is to be inserted formed therein, the replaceable ink container includes an opening plug that plugs the insertion opening, the opening plug includes an outer valve and an inner valve, in an order from an outer side toward an inner side of the replaceable ink container, the outer valve includes an outer valve body that is a valve body for opening and closing, the outer valve is a valve that has the outer valve body pressed and opened in a case where the male connector is inserted into the insertion opening, and has the outer valve body close by making contact with the male connector in a case where the male connector is pulled out from the insertion opening, the inner valve includes an inner valve body that is a valve body for opening and closing, and the inner valve is a valve that has the inner valve body pressed directly or indirectly by the male connector and opened in the case where the male connector is inserted into the insertion opening, and has the inner valve body closed by receiving at least a pressure of the ink in the case where the male connector is pulled out from the insertion opening.

2. The ink supply device according to claim 1, wherein the inner valve is a valve to which closing force is applied by weight of the inner valve body itself in the case where the male connector is pulled out from the insertion opening.

3. The ink supply device according to claim 2, wherein the inner valve further includes: a biasing unit that biases the inner valve body in a direction along which the inner valve body closes.

4. The ink supply device according to claim 1, wherein the inner valve further includes: a biasing unit that biases the inner valve body in a direction along which the inner valve body closes.

5. The ink supply device according to claim 1, wherein at least one of the outer valve and the inner valve is a reed valve, and the reed valve is a valve to which closing force is applied by rigidity of the valve body itself in the case where the male connector is pulled out from the insertion opening.

* * * * *